United States Patent [19]

Reitzel

[11] Patent Number: 4,497,419

[45] Date of Patent: Feb. 5, 1985

[54] ONE-PIECE CAP

[75] Inventor: Henry M. Reitzel, Connersville, Ind.

[73] Assignee: Stant Inc., Connersville, Ind.

[21] Appl. No.: 576,315

[22] Filed: Feb. 2, 1984

[51] Int. Cl.[3] ..... B65D 41/06; B65D 41/36

[52] U.S. Cl. ..... 220/302; 220/293; 220/295; 220/298; 220/DIG. 32; 220/DIG. 33

[58] Field of Search ..... 220/293, 295, 298, 301, 220/302, 210, DIG. 32, DIG. 33

[56] References Cited

U.S. PATENT DOCUMENTS

| | | | |
|---|---|---|---|
| 1,569,881 | 1/1926 | Reid . | |
| 2,733,052 | 1/1956 | Luther | 259/122 |
| 3,010,673 | 11/1961 | Marconi | 242/85.1 |
| 3,331.638 | 7/1967 | Fruth | 301/108 |
| 4,020,970 | 5/1977 | Koscik et al. | 220/293 |
| 4,081,102 | 3/1978 | Sakai | 220/203 |
| 4,160,511 | 7/1979 | Hukuta et al. | 220/210 |
| 4,267,941 | 5/1981 | Loudin | 220/293 |
| 4,300,702 | 11/1981 | Scharrer | 220/295 |

*Primary Examiner*—George T. Hall

*Attorney, Agent, or Firm*—Barnes & Thornburg

[57] ABSTRACT

A cap is disclosed for closing an aperture having a camming surface extending axially inwardly about its periphery. The cap includes a first body portion having a diameter larger than the aperture and a second body portion having an outer diameter smaller than the aperture. A gasket is disposed adjacent the first body portion. A first slot extends diametrally through the second body portion. Second and third chordal slots extend partially through the second body portion and are parallel to the first diametral slot. The first, second, and third slots define first and second parallel lever arms. Each lever arm includes a portion extending radially beyond the outer diameter of the second body portion to engage the camming surface of the aperture.

14 Claims, 5 Drawing Figures

ONE-PIECE CAP

This invention relates to closures for apertures, and more particularly to plastic closure caps for closing oil filler necks.

Crankcases for oil generally include fill apertures through which one can add oil and fuel to the crankcase. Examples of known closure caps for closing fuel and oil fill apertures include those shown in Scharrer U.S. Pat. No. 4,300,702; Sakai U.S. Pat. No. 4,081,102; Koscik et al U.S. Pat. No. 4,020,970; and Reid U.S. Pat. No. 1,569,881. Generally, the caps are made from either metal or plastic and include a pair of colinear, opposed tabs which are received into slots in the edges defining the apertures. The caps are then rotated to engage the tabs against a camming surface in the apertures. Engagement of the tabs with the camming surface serves to maintain the caps in a closed position in the apertures.

Other closure mechanisms used for applications other than those mentioned above are shown in Luther U.S. Pat. No. 2,733,052; Fruth U.S. Pat. No. 3,331,638; and Marconi U.S. Pat. No. 3,010,673.

In accordance with the instant invention, a cap is provided for closing an aperture having a camming surface. The cap comprises a first body portion having a diameter larger than the aperture. A second body portion is provided for insertion into the aperture. The second body portion includes first and second generally parallel, non-colinear arms. The arms are engageable with the camming surface of the aperture.

Illustratively, the second body portion includes a diametral slot which extends through the second body portion to divide the second portion into first and second hemicylinders. Second and third chordal slots are provided which are parallel to the first slot and which extend partially through the second body portion. This three-slot arrangement defines the pair of opposed arms.

One aspect of the present invention is that the cap of the instant invention can be manufactured of plastic, and can be molded in one piece. The one-piece plastic construction enables the cap to be manufactured relatively inexpensively.

One feature of the instant invention is that deformable, opposed lever arms are molded into the cap. This feature has the advantage of providing a cap which will be retained in place and will seal the aperture by exerting pressure against a gasket to compress the gasket. The present invention obviates the need for separate springs to exert pressure against the gasket, since the deformation of the lever arms serves to exert pressure against the gasket. The deformation characteristics of the lever arms can be varied between caps to accommodate different vehicles which may require different caps which exert different pressures on the gasket.

Another feature of the instant invention is that a pair of lever arms can be formed with each having a radial length greater than one half of the outer diameter of the portion of the cap which is inserted into the aperture. Through this arrangement, the lever arm can be made to be more rigid than prior art tabs while still being able to undergo the desired deformation along the camming surface of the aperture. The relatively long length of the lever arm allows a relatively small angle of deformation at the base of the lever arm to result in a relatively long axial deformation at the ends of the lever arms. Thus, the lever arms can be made to be sufficiently rigid and strong to exert a sealing force against the gasket, and to withstand long use, while still providing lever arms which will deform the required axial distance.

Additional features and advantages of the invention will become apparent to those skilled in the art upon consideration of the following detailed description of a preferred embodiment exemplifying the best mode of carrying out the invention as presently perceived. The detailed description particularly refers to the accompanying figures in which.

Figure 1:
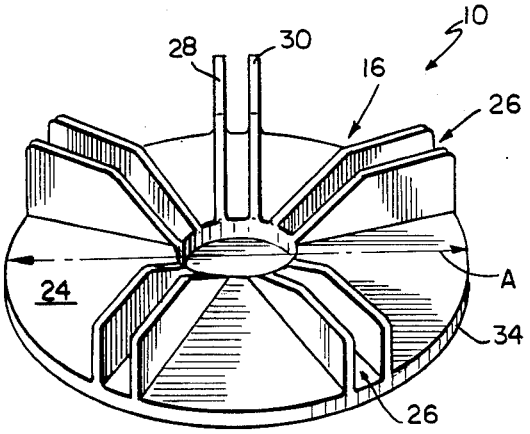
FIG. 1 is a perspective top elevational view of the invention.
Figure 2:
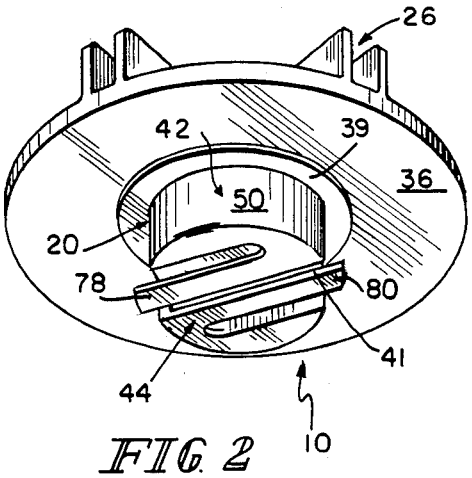
FIG. 2 is a perspective bottom elevational view of the invention.

A plastic closure cap 10 is shown in the figures. The cap 10 is designed for insertion into an aperture 12 to close and seal the aperture 12. Aperture 12 is illustratively shown as being disposed at the end of a filler neck 14 such as an oil filler neck. It is understood that the aperture 12 need not be disposed on a filler neck 14, and alternatively can be disposed in a valve cover (not shown) or other panel-like member. As will be described in greater detail hereunder, fill apertures 12 are generally circular, having a pair of opposed slots through which the cap 10 is inserted into the aperture 12 and a pair of axially inwardly facing camming surfaces for biasing the cap 10 in a sealing position in the aperture 12.

Plastic closure cap 10 includes a first body portion 16 having a diameter A which is larger than the diameter B of aperture 12, and a second body portion 20 which is formed integrally with first body portion 16. Second body portion 20 has an outer diameter C which is slightly less than the diameter B of aperture 12 to enable second body portion 20 to be inserted into aperture 12. Outer diameter C of second body portion 20 should be as large as practicable, while still permitting the second body portion 20 to be inserted into the aperture 12.

First body portion 16 includes an axially outwardly facing surface 24 and a plurality of axially outwardly extending gripping means 26 which are formed in cap 10. Gripping means 26 each include first 28 and second 30 parallel, axially upstanding flange members which can be gripped by the user to apply a rotational force to the cap 10 to rotate the cap 10 into and out of engagement with aperture 12. A generally circular circumferential rim 34 is formed on the edge of the first body portion 16. First body portion 16 also includes an axially inwardly facing surface 36 which includes a radially outwardly disposed portion 37 and a radially inwardly disposed portion 38. Radially outwardly disposed portion 37 and radially inwardly disposed portion 38 are generally parallel, with radially inwardly disposed portion 38 being offset axially inwardly of radially outwardly disposed portion 37. Radially inwardly disposed portion 38 forms a seat for gasket 39.

Gasket 39 is preferably made of a resilient synthetic rubber which is formed separately of plastic cap 10 and is placed into position on plastic cap 10 after cap 10 has been molded. Preferably, gasket 39 has an outer diameter greater than the diameter B of aperture 12, and an inner diameter smaller than the outer diameter C of second body portion 20. A disk-shaped central section 40 is provided for unitarily connecting first body portion 16 with second body portion 20.

Second body portion 20 forms a generally cylindrical section which is bisected along its long axis by a first diametral slot 41 which separates the second body portion 20 into first 42 and second 44 hemicylinders. Each hemicylinder 42, 44 includes radially outwardly facing arcuate surfaces 50, 52, respectively, which are sized to be received within the axially inwardly extending inner wall 54 of aperture 12. Each hemicylinder 42, 44 also includes axially inwardly facing, generally planar bottom surfaces 58, 60, respectively. A radially outwardly facing annular groove 66 is disposed near the axially outward end of second body portion 20 adjacent the radially inwardly disposed portion 38 of axially inwardly facing surface 36 of first body portion 16. Groove 66 is sized to receive gasket 39 to position gasket 39 adjacent the radially inwardly disposed portion 38 of axially inwardly facing surface 36.

Bottom surface 58 of first hemicylinder 42 includes a second chordal slot 72 which extends partially through the axially inwardly facing bottom surface 58. Second slot 72 is disposed generally parallel to diametral slot 41. A third chordal slot 76 extends partially through axially inwardly facing bottom surface 60 of second hemisphere 42. Third slot 76 is also generally parallel to diametral slot 41. First diametral slot 41, second chordal slot 72, and third chordal slot 76 form first 78 and second 80 radially outwardly extending lever (spring) arms. Each lever arm 78, 80 includes an integral lug portion 82, 84, respectively, disposed at the radially outward ends of the lever arms 78, 80. First 78 and second 80 lever arms are disposed in a head-to-tail relation. First 78 and second 80 lever arms are generally parallel, but non-colinear. The lugs 82, 84 are disposed on opposite sides of second body portion 20. The integral lugs 82, 84 of lever arms 78, 80 extend radially outwardly, having a diameter D as measured between the mid-points of the radially outward ends of lugs 82, 84, which is greater than the diameter B of aperture 12.

Each lever arm 78, 80 has a base represented by base lines 88, 90, respectively. The base lines 88, 90 represent the interior, axially extending arcuate wall of second body portion 16. Base lines 88, 90 are the points from which the lever arms 78, 80 can deform from the wall. Thus, the effective, deformable length of lever arm 78 is measured from base line 88 to the farthest radially outward point of lug 82. Likewise, the effective length of lever arm 80 is measured from base line 90 to the farthest radially outward point of lug 84. As is shown best in FIG. 4, the effective length of lever arms 78, 80 is greater than one-half the outer diameter C of second body portion 20. In most cases, the effective length of lever arms 78, 80 will also be greater than one-half the diameter B of aperture 12. The lever arms 78, 80 of the instant invention are longer than the colinear tabs used in known prior art caps. This relatively long length of the lever arms 78, 80 enables them to be made more rigid than known, prior tabs while still enabling the lever arms 78, 80 to undergo the necessary deformation. Rigid lever arms 78, 80 are preferred to exert a greater force against gasket 39 to seal gasket 39 against filler neck 14 when the cap 10 is engaged into aperture 14. The length of the lever arms 78, 80 enables them to be made more rigid since a small angle of deformation near their respective bases 88, 90 will result in a large axial deformation at their respective lugs 82, 84. The relatively long length of the lever arms 78, 80 also enables the manufacturer to provide a cap 10 having sufficient strength and deformation characteristics to exert the necessary force on gasket 39 to form a fluid-tight seal, and to retain the cap 10 in the aperture 12, while still allowing the cap 10 to be made out of plastic.

Figure 3:
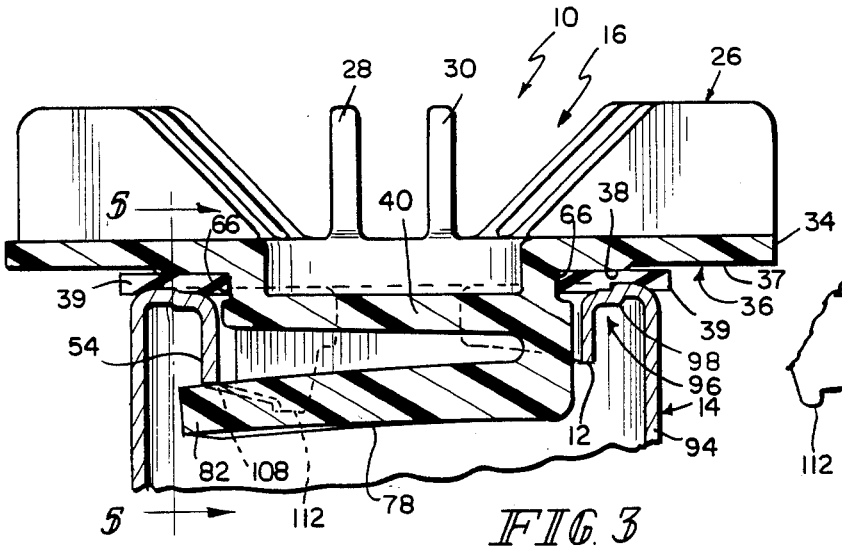
FIG. 3 is a sectional side elevational view of the invention.
Figure 5:
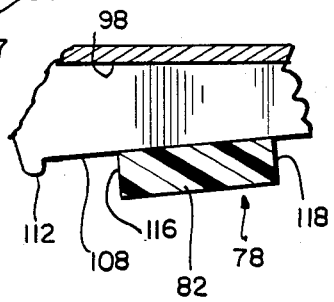
FIG. 5 is a cross-sectional view of the invention taken along lines 5—5 of FIG. 3.
Figure 4:
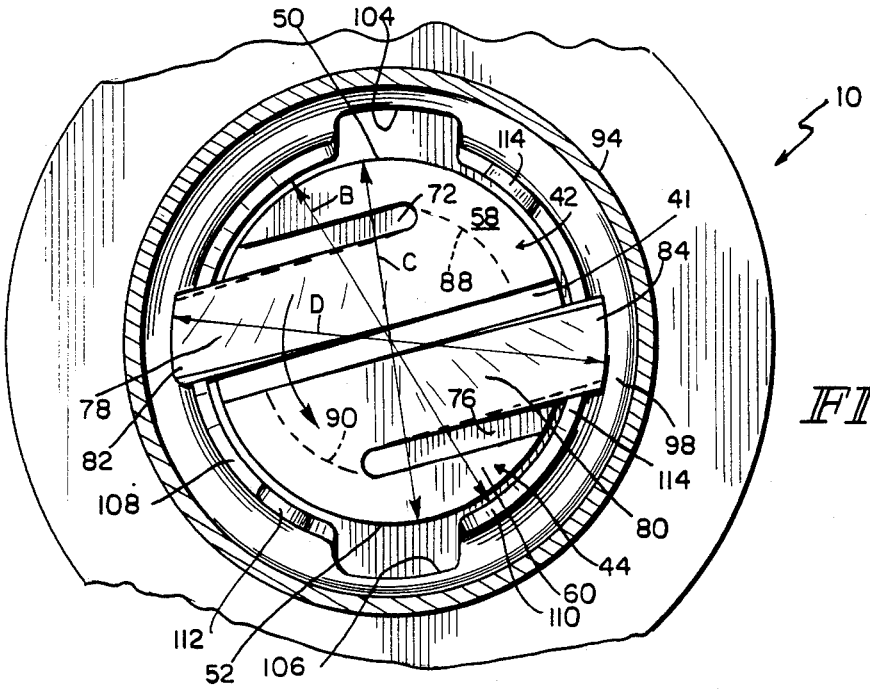
FIG. 4 is a bottom elevational view of the invention.

The cap 10 shown in FIGS. 3–5 is placed in a filler neck 14 having an axially extending outer wall portion 94 which terminates in a rolled lip 96 (edge) having a radially extending portion 98 and axially inwardly extending end portion 54. Diameter B of axially inwardly extending end portion 54 is generally slightly greater than outer diameter C of second body portion 20, as measured between a pair of opposed points on the arcuate, radially outwardly facing surfaces 50, 52 of first 42 and second 44 hemicylinders. The diameter B of axially inwardly extending end portion 54 is less than the diameter D of second body portion 20 as measured between the mid-points of the radially outward ends of lugs 82, 84 of torque arms 78, 80.

Rolled lip 96 includes first 104 and second 106 diametrally opposed slots which are positioned to receive the lever arms 78, 80 to enable the user to place the lever arms 78, 80 axially inwardly of the camming surfaces 108, 110. Camming surfaces 108, 110 are angled axially inwardly to cause the lever arms 78, 80, respectively, to deform increasingly axially inwardly as the cap 10 is rotated in a clockwise direction. Raised stops 112, 114 are provided at the clockwise terminus of camming surfaces 108, 110, respectively, to prevent the rotation of the lever arms 78, 80 past a predetermined point.

The cap 10 operates as follows: In order to place the cap 10 into engagement with the aperture 12, the cap 10 is placed axially outwardly of aperture 12, and the lugs 82, 84 of lever arms 78, 80 are aligned with slots 104, 106, respectively. The cap 10 is moved axially inwardly, moving the lugs 82, 84 through slots 104, 106 until the gasket 39 engages the radially extending top portion 98 of rolled lip 96. At this point, the lugs 82, 84 and lever arms 78, 80 should be positioned axially inwardly of camming surfaces 108, 110. It is understood that as hemicylinders 42, 44 of second body portion 16 are identical, but inverted, lug 82 can be inserted into slot 106 and lug 84 can be inserted into slot 104.

After the lugs 82, 84 have been passed through slots 104, 106, the cap 10 is rotated in a clockwise direction until the lugs 82, 84 are adjacent the stops 112, 114. The clockwise rotation engages the lugs 82, 84 with the camming surfaces 108, 110. Continued clockwise rotation of cap 10 causes the lugs 82, 84 to deform progressively, which progressively compresses gasket 39 between axially inwardly disposed surface 38 of first body portion 16 and the radially inwardly extending top portion 98 of rolled lip 96 to form a fluid-tight seal between the cap 10 and the filler neck 14.

Due to the arcuate nature of base lines 88, 90, the leading edges 116 of the lower arms 78, 80 deform axially inwardly farther than the trailing edges 118 of the lever arms. This angled deformation is caused by the base lines 88, 90 (which represent the points from which the lever arms 78, 80 can deform), presenting deformation points for the lever arms 78, 80 which are not perpendicular to the long axes of the lever arms, but rather are angled therefrom. These angled deformations facilitate the engagement of the lugs 82, 84 with the camming surfaces 108, 111. As best shown in FIG. 5, the ramped nature of the camming surfaces 108, 110 requires the leading edges 116 of the lever arms 78, 80 to deform axially inwardly farther than the trailing edges 118.

What is claimed is:

1. A cap for closing an aperture having a camming surface, the cap comprising a first body portion having a diameter larger than the aperture, and a second body portion for insertion into the aperture, the second body portion including first and second generally parallel, non-colinear arms for engaging the camming surface of the aperture.

2. The invention of claim 1 wherein the arms are deformable and have a deformable length greater than one-half the outer diameter of the second body portion.

3. The invention of claim 1 wherein the second body portion has an outer diameter, and each arm includes a portion extending beyond the outer diameter of the second body portion.

4. The invention of claim 1 further comprising a gasket means for sealing engagement with an edge of the aperture and wherein the arms comprise lever arms which are deformable to provide a force to compress the gasket and retain the cap in the aperture.

5. The invention of claim 1 further comprising a gasket means disposed adjacent the first body portion and wherein the arms comprise deformable lever arms, each lever arm having a deformable length of greater than one-half the outer diameter of the second body portion, the lever arms being deformable to provide a force to compress the gasket to provide a fluid-tight seal at the gasket, and to retain the cap in the aperture.

6. The invention of claim 1 wherein the first body portion includes an axially inwardly facing surface and the second body portion includes an annular groove for positioning a gasket means adjacent the axially inwardly facing surface of the first body portion.

7. The invention of claim 1 wherein the arms are deformable along an axis and about a deformation point angled from a line perpendicular to said axis.

8. A cap for closing a circular aperture having a camming surface extending axially inwardly about its periphery, the cap comprising a first body portion having a diameter larger than the aperture, and a second body portion having a diameter, a first diametral slot extending through the second body portion, and a second and third slot parallel to the first slot and extending partially through the second body portion, the first, second, and third slots defining first and second parallel arms, each arm including a portion extending outwardly beyond the diameter of the second body portion for engaging the camming surface of the aperture.

9. The invention of claim 8 wherein the first body portion includes an axially inwardly facing surface and the second body portion includes an annular groove for positioning a gasket means adjacent the axially inwardly facing surface of the first body portion.

10. The invention of claim 8 further comprising a gasket means for sealing engagement with an edge of the aperture, and wherein the arms comprise spring arms to provide a force to the gasket and retain the cap in the aperture.

11. The invention of claim 8 wherein the portions of the arms which extend outwardly beyond the diameter of the second body portion are positioned to pass through a pair of opposed slots in the aperture.

12. A plastic cap for use with a fluid filling aperture having a pair of axially inwardly facing camming surfaces, the cap comprising a first body portion for placement over the aperture, the first body portion including a grip portion and an inwardly facing surface having a diameter larger than the aperture, a gasket means disposed adjacent the inwardly facing surface, and a second body portion for insertion into the aperture, the second body portion comprising an axially inwardly extending member having a diameter, and first and second parallel, non-colinear arms, the arms extending beyond the outer diameter of the second portion for engaging the camming surfaces of the aperture, the arms being deformable to provide a force to compress the gasket means and to retain the cap in the aperture.

13. A plastic cap for closing an aperture having a camming surface extending axially inwardly about its periphery, the cap comprising a first body portion having a diameter larger than the aperture, and a second body portion having an outer diameter sized to permit the second body portion to be inserted into the aperture, and a pair of plastic deformable arms for engaging the camming surface, each arm having a deformable length greater than one-half the outer diameter of the second body portion.

14. The invention of claim 13 wherein the plastic arms are deformable along an axis and about a deformation point angled from a line perpendicular to said axis.

* * * * *

UNITED STATES PATENT AND TRADEMARK OFFICE

CERTIFICATE OF CORRECTION

PATENT NO. : 4,497,419

DATED : February 5, 1985

INVENTOR(S) : Henry M. Reitzel

It is certified that error appears in the above-identified patent and that said Letters Patent is hereby corrected as shown below:

Column 6, line 11 (claim 10), after "force to", insert --compress--.

Signed and Sealed this

*Twenty-third* Day of *July 1985*

[SEAL]

*Attest:*

DONALD J. QUIGG

*Attesting Officer*

*Acting Commissioner of Patents and Trademarks*